US005500150A

United States Patent [19]

Scheibel et al.

[11] Patent Number: 5,500,150

[45] Date of Patent: Mar. 19, 1996

[54] SOLIDFIED DETERGENT ADDITIVE WITH N-ALKOXY POLYHYDROXY FATTY ACID AMIDE AND ALKOXYLATED SURFACTANT

[75] Inventors: Jeffrey J. Scheibel; Bruce P. Murch; Daniel S. Connor, all of Cincinnati, Ohio

[73] Assignee: The Procter & Gamble Company, Cincinnati, Ohio

[21] Appl. No.: 278,852

[22] Filed: Jul. 26, 1994

Related U.S. Application Data

[63] Continuation-in-part of Ser. No. 119,258, Sep. 9, 1993, abandoned.

[51] Int. Cl.[6] ..... C11D 1/18; C11D 1/12; C11D 1/75; C11D 9/32

[52] U.S. Cl. ..... 252/544; 252/108; 252/117; 252/121; 252/134; 252/174.17; 252/523; 252/525; 252/529; 252/550; 252/554; 252/558; 252/DIG. 1

[58] Field of Search ..... 252/108, 117, 252/121, 554, 550, 558, 523, 525, 529, 174.17, 134, DIG. 1

[56] References Cited

U.S. PATENT DOCUMENTS

| | | | |
|---|---|---|---|
| 3,607,761 | 9/1971 | Feighner et al. | 252/108 |
| 3,654,166 | 4/1972 | Eckert et al. | 252/117 |
| 3,793,214 | 2/1974 | O'Neill et al. | 252/117 |
| 3,916,003 | 10/1975 | Suzuki et al. | 260/404 |
| 5,009,814 | 4/1991 | Kelkenberg et al. | 252/548 |
| 5,174,927 | 12/1992 | Honsa | 252/543 |
| 5,188,769 | 2/1993 | Connor et al. | 252/548 |
| 5,194,639 | 3/1993 | Connor et al. | 554/66 |
| 5,244,593 | 9/1993 | Roselle et al. | 252/99 |
| 5,254,281 | 10/1993 | Pichurdo et al. | 252/108 |
| 5,283,009 | 2/1994 | Speckman et al. | 252/548 |
| 5,318,728 | 6/1994 | Surutzidis et al. | 252/548 |
| 5,332,528 | 7/1994 | Pan et al. | 252/548 |

FOREIGN PATENT DOCUMENTS

| | | | |
|---|---|---|---|
| 3-246265 | 11/1991 | Japan | C07C 233/18 |
| WO92/06171 | 4/1992 | WIPO | C11D 17/00 |
| WO92/06150 | 4/1992 | WIPO | C11D 3/00 |
| WO92/05764 | 4/1992 | WIPO | A61K 7/06 |
| WO92/06151 | 4/1992 | WIPO | C11D 1/52 |
| WO-A-93/05132 | 3/1993 | WIPO | C11D 1/65 |

OTHER PUBLICATIONS

PCT Search Report dated 28 Dec. 1994.

*Primary Examiner*—E. Rollins-Cross
*Assistant Examiner*—Patricia L. Hailey
*Attorney, Agent, or Firm*—Jerry J. Yetter; Jacobus C. Rasser

[57] ABSTRACT

Ethoxylated nonionic or AES surfactants are combined with N-alkoxy or N-aryloxy polyhydroxy fatty acid amides to provide a waxy, solid material which is useful as a stick-form spot remover or as a convenient means for adding otherwise liquid nonionic surfactants to granular detergent compositions, detergent bars and the like. Thus, $C_{12}$–$C_{18}$ alcohol ethoxylates or $C_{12-18}$ ethoxy sulfates are combined with $C_{12}$ fatty acid N-(3-methoxypropyl)glucamide to provide solid, waxy materials useful for cleaning purposes.

12 Claims, No Drawings

SOLIDFIED DETERGENT ADDITIVE WITH N-ALKOXY POLYHYDROXY FATTY ACID AMIDE AND ALKOXYLATED SURFACTANT

CROSS-REFERENCE TO RELATED APPLICATION

This application is a continuation-in-part of application Ser. No. 08/119,258, filed Sep. 9, 1993, now abandoned.

FIELD OF THE INVENTION

The present invention relates to surfactant mixtures for use in detergent compositions.

BACKGROUND OF THE INVENTION

The formulation of effective detergent compositions presents a considerable challenge. Effective compositions are required to remove a variety of soils and stains from diverse substrates. In particular, the removal of greasy/oily soils quickly and efficiently can be problematic and is a particular challenge to the formulator. Various means have been suggested to enhance the grease and oil removal performance of detergent compositions. Grease-cutting nonionic surfactants such as the ethoxylated alcohols and anionic derivatives thereof such as the alkoxy sulfates have been employed, but these tend to be liquids or pasty materials which are difficult to incorporate into dry, free-flowing detergent granules.

The challenge to the detergent manufacturer seeking improved cleaning has been increased by various environmental factors. For example, some nonbiodegradable ingredients have fallen into disfavor. Effective phosphate builders have been banned by legislation in many countries. Moreover, many surfactants are often available only from nonrenewable resources such as petrochemicals. Accordingly, the detergent formulator is quite limited in the selection of surfactants which are effective cleaners, biodegradable and, to the extent possible, available from renewable resources such as natural fats and oils, rather than petrochemicals.

Considerable attention has lately been directed to nonionic surfactants which can be prepared using mainly renewable resources, such as fatty esters and sugars. One such class of surfactants includes the polyhydroxy fatty acid amides, and their use with conventional nonionic surfactants has been reported. However, even these superior surfactants do suffer from some drawbacks. For example, their solubility is not as high as might be desired for optimal formulations. At high concentrations in water they can be difficult to handle and pump, so additives must be employed in manufacturing plants to control their viscosity. While quite compatible with conventional nonionic surfactants, the resulting mixtures still tend to be liquids or pasty materials which, as noted above, can be difficult to formulate into granular compositions. And, of course, there is always the objective to find new surfactants which lower interfacial tensions to an even greater degree than the N-alkyl polyhydroxy fatty acid amides in order to increase cleaning performance.

It has now been determined that the N-alkoxy polyhydroxy fatty acid amide surfactants surprisingly differ from their counterpart N-alkyl polyhydroxy fatty acid amide surfactants in several important and unexpected ways which are of considerable benefit to detergent formulators. The alkoxy-substituted polyhydroxy fatty acid amide surfactants herein substantially reduce interfacial tensions, and thus provide for high cleaning performance in detergent compositions, even at low wash temperatures. The surfactants herein exhibit more rapid dissolution in water than the corresponding N-alkyl polyhydroxy fatty acid amide surfactants, even at low temperatures (5°–30° C.). The high solubility of the surfactants herein allows them to be formulated as modem concentrated detergent compositions. The surfactants herein can be easily prepared as low viscosity, pumpable solutions at concentrations (or melts) as high as 70–100%, which allows them to be easily handled in the manufacturing plant. The high solubility of the surfactants herein makes them more compatible with calcium and magnesium hardness cations, even in relatively concentrated compositions. The surfactants herein are available from mainly renewable resources, rather than petrochemicals, and are biodegradable. The surfactants herein also have the advantage of providing a lower sudsing profile than the N-alkyl polyhydroxy fatty acid amides, which desirably decreases the carry-over of suds into the rinse bath.

Importantly, it has now also been determined that certain N-alkoxy polyhydroxy fatty acid amide surfactants form solid, waxy, lubricious masses when admixed with liquid or pasty alcohol ethoxylate or sulfated ethoxylate surfactants. These waxy masses can be used per se as cleaning and antispotting "sticks", or can be conveniently admixed with granular detersive ingredients to provide free-flowing granular detergents. Thus, the invention herein provides both a new type of solid surfactant mixture and solves the aforementioned problem associated with the incorporation of conventional nonionic and alkoxy sulfate surfactants into granular detergents.

BACKGROUND ART

Japanese Kokai HEI 3[1991]-246265 Osamu Tachizawa, U.S. Pat. Nos. 5,194,639, 5,174,927 and 5,188,769 and WO 9,206,171, 9,206,151, 9,206,150 and 9,205,764 relate to various polyhydroxy fatty acid amide surfactants and uses thereof.

SUMMARY OF THE INVENTION

The present invention relates to solid detergent comprising:

(a) at least about 1%, preferably from about 5% to about 35%, by weight of an amide surfactant of the formula

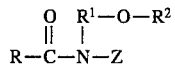

wherein R is a $C_7$–$C_{21}$ hydrocarbyl moiety, $R^1$ is a $C_2$–$C_8$ hydrocarbyl moiety, $R^2$ is a $C_1$–$C_8$ hydrocarbyl or oxy-hydrocarbyl moiety, and Z is a polyhydroxy hydrocarbyl unit having a linear chain with at least two hydroxyls directly connected to the chain; and (b) at least about 1%, preferably from about 5% to about 35%, by weight of a member selected from the group consisting of alkoxylated nonionic surfactants, sulfated alkoxylated anionic surfactants, or mixtures thereof.

In a preferred mode, the compositions are those wherein substituent Z of surfactant (a) is derived from a reducing sugar, especially a reducing sugar which is a member selected from the group consisting of glucose (most preferred), fructose, maltose, xylose and mixtures thereof.

With respect to substituents R, $R^1$ and $R^2$ on surfactant (a): R can be $C_7$–$C_{21}$ alkyl or alkylene and is most preferably $C_{11}$, $R^1$ is ethylene or most preferably propylene (ethylene compounds tend to be higher sudsing than propylene) and $R^2$ is most preferably methyl. Preferred compositions herein have R as $C_{11}$, alkyl, $R^1$ as propylene, $R^2$ as methyl, and Z derived from glucose.

Preferred compositions employ $C_8$–$C_{22}$ alcohol ethoxylates, sulfated $C_{10}$–$C_{20}$ alcohol or alkyl phenol ethoxylates, or mixtures thereof, as surfactant (b).

The fully-formulated detergent compositions provided by this invention may optionally, but preferably, additionally comprise at least about 1% by weight of additional sulfated or sulfonated anionic surfactants.

Especially high sudsing, high grease removal versions of the compositions herein may also comprise at least about 1% by weight of an additional surfactant which is a member selected from the group consisting of alkoxy carboxylate, amine oxide, betaine and sultaine surfactants, and mixtures thereof. Such surfactants may be used alone, or in combination with sulfated or sulfonated surfactants.

In yet another mode, the compositions herein will additionally comprise at least about 0.05% by weight of calcium ions, magnesium ions, or mixtures thereof, to still further enhance grease removal and high sudsing performance.

The invention also provides a method for cleaning fabrics, hard surfaces or dishware, comprising contacting same with an aqueous medium containing at least about 200 ppm of the compositions herein, preferably with agitation.

All percentages, ratios and proportions herein are by weight, unless otherwise specified. All documents cited are incorporated herein by reference.

DETAILED DESCRIPTION OF THE INVENTION

The N-alkoxy and N-aryloxy polyhydroxy fatty acid amide surfactants used in the practice of this invention are quite different from traditional ethoxylated nonionics, due to the use of a linear polyhydroxy chain as the hydrophilic group instead of the ethoxylation chain. Conventional ethoxylated nonionic surfactants have cloud points with the less hydrophilic ether linkages. They become less soluble, more surface active and better performing as temperature increases, due to thermally induced randomness of the ethoxylation chain. When the temperature gets lower, ethoxylated nonionics become more soluble by forming micelles at very low concentration and are less surface active, and lower performing, especially when washing time is short.

In contrast, the polyhydroxy fatty acid amide surfactants have polyhydroxyl groups which are strongly hydrated and do not exhibit cloud point behavior. It has been discovered that they exhibit Krafft point behavior with increasing temperature and thus higher solubility at elevated temperatures. They also have critical micelle concentrations similar to anionic surfactants, and it has been surprisingly discovered that they clean like anionics.

Moreover, the polyhydroxy fatty acid amides herein are different from the alkyl polyglycosides (APG) which comprise another class of polyhydroxyl nonionic surfactants. While not intending to be limited by theory, it is believed that the difference is in the linear polyhydroxyl chain of the polyhydroxy fatty acid amides vs. the cyclic APG chain which prevents close packing at interfaces for effective cleaning.

With respect to the N-alkoxy and N-aryloxy polyhydroxy fatty acid amides, such surfactants have now been found to have a much wider temperature usage profile than their N-alkyl counterparts, and they require no or little cosurfactants for solubility at temperatures as low as 5° C. Such surfactants also provide easier processing due to their lower melting points. It has now further been discovered that these surfactants are biodegradable.

As is well-known to formulators, most laundry detergents are formulated with mainly anionic surfactants, with nonionics sometimes being used for grease/oil removal. Since it is well known that nonionic surfactants are far better for enzymes, polymers, soil suspension and skin mildness, it would be preferred that laundry detergents use more nonionic surfactants. Unfortunately, traditional nonionics do not clean well enough in cooler water with short washing times.

It has now also been discovered that the N-alkoxy and N-aryloxy polyhydroxy fatty acid amide surfactants herein provide additional benefits over conventional nonionics, as follows:

a. Much enhanced stability and effectiveness of new enzymes, like cellulase and lipase, and improved performance of soil release polymers;

b. Much less dye bleeding from colored fabrics, with less dye transfer onto whites;

c. Better water hardness tolerance;

d. Better greasy soil suspension with less redeposition onto fabrics;

e. The ability to incorporate higher levels of surfactants not only into Heavy Duty Liquid Detergents (HDL's), but also into Heavy Duty Granules (HDG's) with the new solid surfactants herein; and f. The ability to formulate stable, high performance "All-Nonionic" or "High Nonionic/Low Anionic" HDL and HDG compositions.

N-Alkoxy and N-Aryloxy Polyhydroxy Fatty Acid Amides

The amide surfactants used herein comprise the N-alkoxy- and N-aryloxy-substituted polyhydroxy fatty acid amides of the formula:

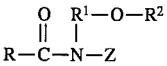

wherein: R is $C_7$–$C_{21}$ hydrocarbyl, preferably $C_9$–$C_{17}$ hydrocarbyl, including straight-chain (preferred), branched-chain alkyl and alkenyl, as well as substituted alkyl and alkenyl, e.g., 12-hydroxyoleic, or mixtures thereof; $R^1$ is $C_2$–$C_8$ hydrocarbyl including straight-chain, branched-chain and cyclic (including aryl), and is preferably $C_2$–$C_4$ alkylene, i.e., $—CH_2CH_2—$, $—CH_2CH_2CH_2—$ and $—CH_2(CH_2)_2CH_2—$; and $R^2$ is $C_1$–$C_8$ straight-chain, branched-chain and cyclic hydrocarbyl including aryl and oxy-hydrocarbyl, and is preferably $C_2$–$C_4$ alkyl or phenyl; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 1 to 5, inclusive, and R' is H or a cyclic mono- or polysaccharide, and alkoxylated derivatives thereof. Most preferred are glycityls wherein n is 4, particularly $—CH_2—(CHOH)_4—CH_2OH$.

In compounds of the above formula, nonlimiting examples of the amine substituent group $—R^1—O—R^2$ can be, for example: 2-methoxyethyl-, 3-methoxypropyl-, 4-methoxybutyl-, 5-methoxypentyl-, 6-methoxyhexyl-, 2-ethoxyethyl-, 3-ethoxypropyl-, 2-methoxypropyl, methoxybenzyl-, 2-isopropoxyethyl-, 3-isopropoxypropyl-, 2-(t-butoxy)ethyl-, 3-(t-butoxy)propyl-, 2-(isobutoxy)ethyl-, 3-(isobutoxy)propyl-, 3-butoxypropyl, 2-butoxyethyl, 2-phenoxyethyl-, methoxycyclohexyl-, methoxycyclohexylmethyl-, tetrahydrofurfuryl-, tetrahydropyranyloxyethyl-, 3-[2-methoxyethoxy]propyl-, 2-[2-methoxyethoxy]ethyl, 3-[2methoxypropoxy]propyl-, 2-[3-methoxypropoxy]ethyl-, 3-[methoxypolyethyleneoxy]propyl-, 3-[4-methoxybutoxy]propyl-, 3-[2-methoxyisopropoxy]propyl-, $CH_3O—CH_2CH(CH_3)—$ and $CH_3OCH_2CH(CH_3)CH_2—O—(CH_2)_3—$.

R—CO—N< can be, for example, cocamide, stearamide, oleamide, lauramide, myristamide, capricamide, palmitamide, tallowamide, ricinolamide, etc.

While the synthesis of N-alkoxy or N-aryloxy polyhydroxy fatty acid amides can prospectively be conducted using various processes, contamination with cyclized by-products and other colored materials may be problematic. As an overall proposition, the preferred synthesis method for these surfactants comprises reacting the appropriate N-alkoxy or N-aryloxy-substituted aminopolyols with, preferably, fatty acid methyl esters with or without a solvent using an alkoxide catalyst (e.g., sodium methoxide or the sodium salts of glycerin or propylene glycol) at temperatures of about 85° C. to provide product having desirable low levels (preferably, less than about 10%) of ester amide or cyclized by-products and also with improved color and improved color stability, e.g., Gardner Colors below about 4, preferably between 0 and 2. If desired, any unreacted N-alkoxy or N-aryloxy amino polyol remaining in the product can be acylated with an acid anhydride, e.g., acetic anhydride, maleic anhydride, or the like, in water at 50° C.–85° C. to minimize the overall level of such residual amines in the product. Residual sources of straight-chain primary fatty acids, which can suppress suds, can be depleted by reaction with, for example, monoethanolamine at 50° C.–85° C.

If desired, the water solubility of the solid N-alkoxy polyhydroxy fatty acid amide surfactants herein can be enhanced by quick cooling from a melt. While not intending to be limited by theory, it appears that such quick cooling re-solidifies the melt into a metastable solid which is more soluble in water than the pure crystalline form of the N-alkoxy polyhydroxy fatty acid amide. Such quick cooling can be accomplished by any convenient means, such as by use of chilled (0° C.–10° C.) rollers, by casting the melt onto a chilled surface such as a chilled steel plate, by means of refrigerant coils immersed in the melt, or the like.

By "cyclized by-products" herein is meant the undesirable reaction by-products of the primary reaction wherein it appears that the multiple hydroxyl groups in the polyhydroxy fatty acid amides can form ring structures. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such materials are not cyclized by-products, as defined herein.

Usage levels of the aforesaid N-alkoxy- or N-aryloxy-polyhydroxy fatty acid amides herein typically range from about 20% to about 90%, preferably from about 40% to about 60%, by weight of the solidified compositions herein.

The following illustrates the syntheses in more detail.

EXAMPLE I

Preparation of N-(2-methoxyethyl)glucamine

N-(2-methoxyethyl)glucosylamine (sugar adduct) is prepared starting with 1728.26 g of 50 wt. % 2-methoxyethylamine in water (11.5 moles, 1.1 mole equivalent of 2-methoxyethylamine) placed under an $N_2$ blanket at 10° C. 2768.57 grams of 50 wt. % glucose in water (10.46 moles, 1 mole equivalent of glucose), which is degassed with $N_2$, is added slowly, with mixing, to the methoxyethylamine solution keeping the temperature below 10° C. The solution is mixed for about 40 minutes after glucose addition is complete. It can be used immediately or stored 0° C.–5° C. for several days.

About 278 g (~15 wt. % based on amount of glucose used) of Raney Ni (Activated Metals & Chemicals, Inc. product A-5000) is loaded into a 2 gallon reactor (316 stainless steel baffled autoclave with DISPERSIMAX hollow shaft multiblade impeller) with 4 L of water. The reactor is heated, with stirring, to 130° C. at about 1500 psig hydrogen for 30 minutes. The reactor is then cooled to room temperature and the water removed to 10% of the reactor volume under hydrogen pressure using an internal dip tube.

The reactor is vented and the sugar adduct is loaded into the reactor at ambient hydrogen pressure. The reactor is then purged twice with hydrogen. Stirring is begun, the reactor is heated to 50° C., pressurized to about 1200 psig hydrogen and these conditions are held for about 2 hours. The temperature is then raised to 60° C. for 10 minutes, 70° C. for 5 minutes, 80° C. for 5 minutes, 90° C. for 10 minutes, and finally 100° C. for 25 minutes.

The reactor is then cooled to 50° C. and the reaction solution is removed from the reactor under hydrogen pressure via an internal dip tube and through a filter in closed communication with the reactor. Filtering product under hydrogen pressure allows removal of any nickel particles without nickel dissolution.

Solid N-(2-methoxyethyl)glucamine is recovered by evaporation of water and excess 2-methoxyethylamine. The product purity is approximately 90% by G.C. Sorbitol is the major impurity at about 10%. The N-(2-methoxyethyl)glucamine can be used as is or purified to greater than 99% by recrystallization from methanol.

EXAMPLE II

Preparation of $C_{12}$-N-(2-Methoxyethyl)glucamide

N-(2-methoxyethyl)glucamine, 1195 g (5.0 mole; prepared according to Example I) is melted at 135° C. under nitrogen. A vacuum is pulled to 30 inches (762 mm) Hg for 15 minutes to remove gases and moisture. Propylene glycol, 21.1 g (0.28 mole) and fatty acid methyl ester (Procter &

Gamble CE 1295 methyl ester) 1097 (5.1 mole) are added to the preheated amine. Immediately following, 25% sodium methoxide, 54 g (0.25 mole) is added in halves.

Reactants weight: 2367.1 g

Theoretical MeOH generated: (5.0×32)+(0.75×54)+(0.24×32)=208.5 g

Theory product: FW422 2110g 5.0mole

The reaction mixture is homogeneous within 2 minutes of adding the catalyst. It is cooled with warm $H_2O$ to 85° C. and allowed to reflux in a 5-liter, 4-neck round bottom flask equipped with a heating mantle, Trubore stirrer with Teflon paddle, gas inlet and outlet, Thermowatch, condenser, and air drive motor. When catalyst is added, time=0. At 60 minutes, a GC sample is taken and a vacuum of 7 inches (178 mm) Hg is started to remove methanol. At 120 minutes, another GC sample is taken and the vacuum has been increased to 10 inches (254 mm) Hg. At 180 minutes, another GC sample is taken and the vacuum has been increased to 16 inches (406 mm) Hg. After 180 minutes at 85° C., the remaining weight of methanol in the reaction is 4.1% based on the following calculation: 2251 g current reaction wt.–(2367.1 g reactants wt.–208.5 g theoretical MeOH)/2251 g=4.1% MeOH remaining in the reaction. After 180 minutes, the reaction is bottled and allowed to solidify at least overnight to yield the desired product.

EXAMPLE III

Preparation of N-(3-methoxypropyl)glucamine

About 300 g (about 15 wt. % based on amount of glucose used) of Raney Ni (Activated Metals & Chemicals, Inc. product A-S000 or A-5200) is contained in a 2 gallon reactor (316 stainless steel baffled autoclave with DISPERSIMAX hollow shaft multi-blade impeller) pressurized to about 300 psig with hydrogen at room temperature. The nickel bed is covered with water taking up about 10% of the reactor volume.

1764.8 g (19.8 moles, 1.78 mole equivalent) of 3-methoxypropylamine (99%) is maintained in a separate reservoir which is in closed communication with the reactor. The reservoir is pressurized to about 100 psig with nitrogen. 4000 g of 50 wt. % glucose in water (11.1 moles, 1 mole equivalent of glucose) is maintained in a second separate reservoir which is also in closed communication with the reactor and is also pressurized to about 100 psig with nitrogen.

The 3-methoxypropylamine is loaded into the reactor from the reservoir using a high pressure pump. Once all the 3-methoxypropylamine is loaded into the reactor, stirring is begun and the reactor heated to 60° C. and pressurized to about 800 psig hydrogen. The reactor is stirred at 60° C. and about 800 psig hydrogen for about 1 hour.

The glucose solution is then loaded into the reactor from the reservoir using a high pressure pump similar to the amine pump above. However, the pumping rate on the glucose pump can be varied and on this particular run, it is set to load the glucose in about 1 hour. Once all the glucose has been loaded into the reactor, the pressure is boosted to about 1500 psig hydrogen and the temperature maintained at 60° C. for about 1 hour. The temperature is then raised to 70° C. for 10 minutes, 80° C. for 5 minutes, 90° C. for 5 minutes, and finally 100° C. for 15 minutes.

The reactor is then cooled to 60° C. and the reaction solution is removed from the reactor under hydrogen pressure via an internal dip tube and through a filter in closed communication with the reactor. Filtering under hydrogen pressure allows removal of any nickel particles without nickel dissolution.

Solid N-(3-methoxypropyl)glucamine is recovered by evaporation of water and excess 3-methoxypropylamine. The product purity is approximately 90% by G.C. Sorbitol is the major impurity at about 3%. The N-(3-methoxypropyl)glucamine can be used as is or purified to greater than 99% by recrystallization from methanol.

EXAMPLE IV

Preparation of $C_{12}$-N-(3-Methoxypropyl)glucamide

N-(3-methoxypropyl)glucamine, 1265 g (5.0 mole prepared according to Example III) is melted at 140° C. under nitrogen. A vacuum is pulled to 25 inches (635 mm) Hg for 10 minutes to remove gases and moisture. Propylene glycol, 109 g (1.43 mole) and CE 1295 methyl ester, 1097 (5.1 mole) are added to the preheated amine. Immediately following, 25% sodium methoxide, 54 g (0.25 mole) is added in halves.

Reactants weight: 2525 g

Theoretical MeOH generated: (5.0×32)+(0.75×54)+(0.24×32)=208.5 g

Theory product: FW 436 2180 g 5.0 mole

The reaction mixture is homogeneous within 1 minute of adding the catalyst. It is cooled with warm $H_2O$ to 85° C. and allowed to reflux in a 5-liter, 4-neck round bottom flask equipped with a heating mantle, Trubore stirrer with Teflon paddle, gas inlet and outlet, Thermowatch, condenser, and air drive motor. When catalyst is added, time=0. At 60 minutes, a GC sample is taken and a vacuum of 7 inches (178 mm) Hg is started to remove methanol. At 120 minutes, another GC sample is taken and the vacuum has been increased to 12 inches (305 mm) Hg. At 180 minutes, another GC sample is taken and the vacuum has been increased to 20 inches (508 mm) Hg. After 180 minutes at 85° C., the remaining weight of methanol in the reaction is 2.9% based on the following calculation: 2386 g current reaction wt.–(2525 g reactants wt.–208.5 g theoretical MeOH)/2386 g=2.9% MeOH remaining in the reaction. After 180 minutes, the reaction is bottled and allowed to solidify at least overnight to yield the desired product.

EXAMPLE V

$C_{18}$ Methoxypropyl Glucamide

N-(3-methoxypropyl)glucamine, 40 g (0.158 mole) is melted at 145° C. under nitrogen. A vacuum is applied to 38.1 cm (15 inches) Hg for 5 minutes to remove gases and moisture. Separately, methylstearate, 7.19 g (0.158 mole) is preheated to 130° C. and added to the melted amine with rapid stirring along with 9.0 grams of propylene glycol (10 weight % based on reactants). Immediately following, 25% sodium methoxide, 1.7 g (0.0079 mole) is added.

The reaction mixture is homogeneous within 2 minutes of adding the catalyst at 130° C. It is allowed to reflux in order to cool to 85°–90° C. in a 250 ml, 3 neck round bottom flask equipped with a hot oil bath, TRUBORE stirrer with TEFLON paddle, gas inlet and outlet, THERMOWATCH, condenser, and stirrer motor. The reaction requires about 35 minutes to reach 90° C. After 3 hours at 85°–90° C. a vacuum is applied to remove methanol. The reaction mixture is poured out into a jar after a total of 4 hours. The solid reaction product is recrystallized from 400 mls of acetone and 20 mls of methanol. The filter cake is washed twice with 100 ml portions of acetone and is dried in a vacuum oven. A second recrystallization is performed on 51.91 grams of the product of the first recrystallization using 500 mls acetone and 50 mls methanol to give after filtration, washing with two 100 ml portions of acetone and drying in a vacuum oven a yield of 47.7 grams of the N-octadecanoyl-N-(3-methoxypropyl)glucamine. Melting point of the sample is 80° C.–89° C. If desired, the product can be further purified using an acetone/methanol solvent.

EXAMPLE VI

$C_{16}$ Methoxypropyl Glucamide

The reaction of Example V is repeated using an equivalent amount of methyl palmitate to replace the methyl stearate. The resulting hexadecanoyl-N-(3-methoxypropyl)glucamine has a melting point of 84° C. If desired, the product can be further purified using an acetone/methanol solvent.

EXAMPLE VII

Mixed Palm Fatty Acid Methoxypropyl Glucamide

N-(3-methoxypropyl)glucamine, 1265 g (5.0 mole) is melted at 145° C. under nitrogen. A vacuum is applied to 38.1 cm (15 inches) Hg for 10 minutes to remove gases and moisture. Separately, hardened palm stearine methyl ester, 1375 g (5.0 mole) is preheated to 130° C. and added to the melted amine with rapid stirring. Immediately following, 25% sodium methoxide, 54 g (0.25 mole) is added through a dropping funnel. Half the catalyst is added before the reaction is homogeneous to control the hard reflux of methanol. After homogeneity is reached, the other half of the catalyst is added within 10 minutes.

Reactants weight: 2694 g

Theoretical MeOH generated: (5.0×32)+(0.75×54)+(0.25×32)=208.5 g MeOH

Theory product: FW 496 2480 g 5.0 mole

The reaction mixture is homogeneous within 5 minutes of adding the first half of the catalyst at 132° C. It is allowed to reflux in order to cool to 90°–95° C. in a 5 liter, 4 neck round bottom flask equipped with a heating mantle, TRUBORE stirrer with TEFLON paddle, gas inlet and outlet, THERMOWATCH, condenser, and air drive motor. When the first half of the catalyst is added, time=0. At 40 minutes, a vacuum of 25.4 cm (10 inches) Hg is applied to remove methanol. At 48 minutes, vacuum is increased to 43.2 cm (17 inches) Hg. At 65 minutes, the remaining weight of methanol in the reaction is 2.9% based on the following calculation:

2559 g current reaction wt–(2694 g reactants wt–208.5 g theoretical MeOH)/2559 g=2.9% MeOH remaining in the reaction.

By 120 minutes, the vacuum has been increased to 50.8 cm (20 inches) Hg. At 180 minutes, the vacuum has been increased to 58.4 cm (23 inches) Hg and the reaction is poured into a stainless pan and allowed to solidify at room temperature. Also, the remaining weight of methanol is calculated to be 1.3%. After sitting for 4 days, it is hand ground for use.

Fatty glyceride esters can also be used in the foregoing process. Natural plant oils such as palm, soy and canola, as well as tallow are typical sources for such materials. Thus, in an alternate mode, the above process is conducted using palm oil to provide the desired mixture of N-alkoxyglucamide surfactants.

In the general manner of Example IV (with methanol solvent) or V, oleyl-N-(3-methoxypropyl)glucamine is prepared by reacting 49.98 grams of N-(3-methoxypropyl)glucamine with 61.43 g of methyl oleate in the presence of 4.26 g of 25 wt % $NaOCH_3$. The oleyl derivative of N-(2-methoxyethyl)glucamine is prepared in like manner. Palm kernel oil derivatives can be prepared in like manner.

Glyceride Process

If desired, the N-alkoxy and N-aryloxy surfactants used herein may be made directly from natural fats and oils rather than fatty acid methyl esters. This so-called "glyceride process" results in a product which is substantially free of conventional fatty acids such as lauric, myristic and the like, which are capable of precipitating as calcium soaps under wash conditions, thus resulting in unwanted residues on fabrics or filming/spotting in, for example, hard surface cleaners and dishware cleaners.

Triglyceride Reactant

The reactant used in the glyceride process can be any of the well-known fats and oils, such as those conventionally used as foodstuffs or as fatty acid sources. Non-limiting examples include: CRISCO oil; palm oil; palm kernel oil; corn oil; cottonseed oil; soybean oil; tallow; lard; canola oil; rapeseed oil; peanut oil; tung oil; olive oil; menhaden oil; coconut oil; castor oil; sunflower seed oil; and the corresponding "hardened", i.e., hydrogenated oils. If desired, low molecular weight or volatile materials can be removed from the oils by steam-stripping, vacuum stripping, treatment with carbon or "bleaching earths" (diatomaceous earth), or cold tempering to further minimize the presence of malodorous by-products in the surfactants prepared by the glyceride process.

N-substituted Polyhydroxy Amine Reactant

The N-alkyl, N-alkoxy or N-aryloxy polyhydroxy amines used in the process are commercially available, or can be prepared by reacting the corresponding N-substituted amine with a reducing sugar, typically in the presence of hydrogen and a nickel catalyst as disclosed in the art. Non-limiting examples of such materials include: N-(3-methoxypropyl) glucamine; N-(2-methoxyethyl) glucamine; and the like.

Catalyst

The preferred catalysts for use in the glyceride process are the alkali metal salts of polyhydroxy alcohols having at least two hydroxyl groups. The sodium (preferred), potassium or lithium salts may be used. The alkali metal salts of monohydric alcohols (e.g., sodium methoxide, sodium ethoxide, etc.) could be used, but are not preferred because of the formation of malodorous short-chain methyl esters, and the like. Rather, it has been found to be advantageous to use the alkali metal salts of polyhydroxy alcohols to avoid such problems. Typical, non-limiting examples of such catalysts include sodium glycolate, sodium glycerate and propylene glycolates such as sodium propyleneglycolate (both 1,3- and 1,2-glycolates can be used; the 1,2-isomer is preferred), and 2-methyl-1,3-propyleneglycolate. Sodium salts of NEODOL-type ethoxylated alcohols can also be used.

Reaction Medium

The glyceride process is preferably not conducted in the presence of a monohydric alcohol solvent such as methanol, because malodorous acid esters may form. However, it is preferred to conduct the reaction in the presence of a material such as an alkoxylated alcohol or alkoxylated alkyl phenol of the surfactant type which acts as a phase transfer agent to provide a substantially homogeneous reaction mixture of the polyhydroxy amine and oil (triglyceride) reactants. Typical examples of such materials include: NEODOL10-8, NEODOL 23-3, NEODOL 25-12 AND NEODOL 11-9. Pre-formed quantities of the N-alkoxy and N-aryloxy polyhydroxy fatty acid amides, themselves, can also be used for this purpose. In a typical mode, the reaction medium will comprise from about 10% to about 25% by weight of the total reactants.

Reaction Conditions

The glyceride process is preferably conducted in the melt. N-substituted polyhydroxy amine, the phase transfer agent (preferred NEODOL) and any desired glyceride oil are co-melted at 120° C.–140° C. under vacuum for about 30 minutes. The catalyst (preferably, sodium propylene glycolate) at about 5 mole % relative to the polyhydroxy amine is added to the reaction mixture. The reaction quickly becomes homogeneous. The reaction mixture is immediately cooled to about 85° C. At this point, the reaction is nearly complete. The reaction mixture is held under vacuum for an additional hour and is substantially complete at this point.

In an alternate mode, the NEODOL, oil, catalyst and polyhydroxy amine are mixed at room temperature. The mixture is heated to 85° C.–90° C., under vacuum. The reaction becomes clear (homogeneous) in about 75 minutes. The reaction mixture is maintained at about 90° C., under vacuum, for an additional two hours. At this point the reaction is complete.

In the glyceride process, the mole ratio of triglyceride oil:polyhydroxy amine is typically in the range of about 1:2 to 1:3.1.

Product Work-Up:

The product of the glyceride process will contain the polyhydroxy fatty acid amide surfactant and glycerol. The glycerol may be removed by distillation, if desired. If desired, the water solubility of the solid polyhydroxy fatty acid amide surfactants can be enhanced by quick cooling from a melt, as noted above.

Nonionic Surfactants

The non-amide nonionic surfactants which can be used herein to form solid masses with the amide surfactant comprise the general and well-known class of water-soluble alkoxylated, especially ethoxylated, derivatives of linear or branched $C_8$–$C_{22}$ alcohols and $C_6$–$C_{12}$ alkyl phenols. Such surfactants typically comprise the condensation product of one mole of alcohol or alkyl phenol with 1 to about 20, preferably 1 to about 10, more preferably 2 to about 6, moles of ethylene oxide (EO). Such surfactants are commercially available as mixtures (e.g., NEODOL, DOBANOL, ISOFOL) and comprise an average value of ethoxy units per mole of alcohol or alkyl phenol, e.g., $C_{12-14}$ (EO2.5) represents a $C_{12}$–$C_{14}$ alcohol mixture with varying amounts of ethylene oxide which average out as 2.5 ethoxy units. (The so-called "topped" or "T" nonionics are those wherein the base alcohol or alkyl phenol and the monoethoxylated materials are removed by distillation.) Typical, but nonlimiting, examples of such nonionic surfactants useful herein include: $C_{12}$_16(EO3); $C_{12-14}$(EO2.5); $C_{16-18}$(EO10); $C_{12-14}$(EO5); coconutalkyl (EO6.5); $C_{14-18}$(EO6); $C_{14-18}$(EO3); $C_8H_{17}C_6H_5$(EO6); $C_{10}H_{21}C_6H_5$(EO3) and the like.

Sulfated Alkoxylated Surfactants

The preferred alkoxylated anionic surfactants which form solid masses with the amide surfactant in the manner of this invention comprise the well-known class of alkyl ethoxy sulfates ("AES"). Such AES surfactants are typically the sulfated reaction product formed from $C_{10}$–$C_{20}$ ethoxylated alcohols comprising from 1 to about 10, preferably 1 to about 6, ethoxy units. Typical, but nonlimiting, examples include coconutalkyl EO(3) sulfate, oleyl (EO)6 sulfate, $C_{12}H_{25}$ EO(3.5) sulfate, tallowalkyl (EO6) sulfate and the like. The AES surfactants are typically used in the form of water-soluble salts, e.g., $Na^+$, alkanolammonium and the like.

Another type of sulfated surfactant of the same general class which can be used in like manner are the sulfated alkyl phenol alkoxylates. Such surfactants include the sulfated reaction product formed from $C_6$–$C_{18}$ alkyl phenol ethoxylates comprising from about 1 to about 10, preferably 1 to about 6, ethoxy units. Typical, but non-limiting examples include hexylphenyl $(EO)_3$ sulfate, decylphenyl $(EO)_6$ sulfate and octylphenyl $(EO)_{2.5}$ sulfate. Any water-soluble salt form of such surfactants may be used herein.

In the present invention, the aforesaid N-alkoxy polyhydroxy fatty acid amide surfactants (a) are admixed with the alkoxylated or sulfated alkoxylated surfactants (or mixtures) thereof (b) at a weight ratio of (a):(b) from about 3:1 to 1:3, most preferably 3:1 to 1:1, in the melt form (preferably anhydrous), whereby the desired semisolid or solid (waxy) mass forms on standing at room temperature. The following TESTS illustrate this effect in more detail, but are not intended to be limiting of the compositions provided by this invention.

TESTS $C_{12}$-N-(3-methoxypropyl)glucamide (high purity) is used in the following. Various mixtures with the indicated weight ratios are used with the ethoxylated nonionic surfactants NEODOL 23-6.5T and NEODOL R 23-3. Water is added in two examples noted by asterisks. Crude palm N-methoxypropylglucamide is used in one mixture noted by #.

| | PHASE INFORMATION | | |
|---|---|---|---|
| COMPOSITION | Solidifaction t | Remelt t | Resolid t |
| $C_{12}$-N-(3-methoxypropyl) glucamide:NEODOL:$H_2O$ with 23-6.5T | | | |
| 100%:0%:0% | 47° C. | 78° C. | — |
| 90%:10%:0% | 50° C. | — | — |
| 67%:33%:0% | 47–50° C. | — | — |
| 50%:50%:0% | 47–50° C | — | — |
| Palm 100%:0%:0%# | Melting point is ~100° C. for palm | | |
| Palm 67%:34%:0%# | 40° C. | 90° C. | 35° C.# palm |
| $C_{12}$-N-(3-methoxypropyl) glucamide with NEODOL R 23-3 | | | |
| 90%:10%:0% | 40–45° C. | 65° C. | — |
| 76%:24%:0% | 50° C. | 65° C. | — |
| 50%:50%:0% | 47° C. | — | — |
| 49%:48%:3% | 35° C. | 50–55° C. | —* |
| 46%:46%:8% | RT | 30° C. | —* |

*The systems with 3% and 8% water when solidified are soft pastes.

NEODOL 23-6.5T lowers the solidification point of palm methoxypropylglucamide significantly. NEODOLS do not have any significant effect on the solidification point of the $C_{12}$ methoxypropylglucamide. NEODOL seems to promote rapid formation of solid at appropriate temperature vs the 100% methoxypropylglucamide surfactant which tends to go to gel initially then slowly form a solid.

Co-melt of $C45AE_{2.25}S$ with C1295 Methoxypropyl Glucose Amide

A 50% active solution of $C45AE_{2.25}S$, i.e., $C_{14-15}$ EO(2.25) sulfate, is diluted to 10% in water and freeze dried overnight. One gram of this solid is co-melted with one gram of C1295 methoxypropyl glucose amide in a small vial with a heat gun. After thoroughly mixing the co-melt with a spatula, it is immediately poured onto a small watch glass. This is referred to as the 1:1 ratio of C1295 methoxypropyl glucose amide to AES.

Separately, 0.7 grams of the freeze dried $C45AE_{2.25}S$ is co-melted with 1.4 grams of C1295 methoxypropyl glucose amide. It is thoroughly mixed and poured onto a watch glass. This is referred to as the 2:1 ratio of C1295 methoxypropyl glucose amide to AES.

After sitting overnight at room temperature and about 40% relative humidity, both samples are very soft and tacky. They are confirmed to be in the liquid crystal state.

Two days later after sitting over the weekend, the 2:1 ratio sample is solidified to a soft solid while the 1:1 ratio sample is still very soft and tacky.

Adjunct Ingredients

Fully formulated detergent compositions which comprise the aforesaid solidifed mixtures can optionally include one or more other detergent adjunct materials or other materials for assisting or enhancing cleaning performance, or to modify the aesthetics of the detergent composition (e.g., perfumes, colorants, dyes, etc.). Such adjunct ingredients can be added to fully formulated detergents which comprise the solid (or semisolid) mixtures of surfactants (a) and (b) using conventional granulating, agglomerating or mixing equipment. The following are illustrative examples of such adjunct materials.

Adjunct Surfactants

The fully-formulated compositions herein which comprise the mixture of surfactants (a) and (b) can optionally, and preferably contain various other anionic, zwitterionic, etc. surfactants. If used, such adjunct surfactants are typically present at levels of from about 5% to about 35% of the compositions.

Nonlimiting examples of optional surfactants useful herein include the conventional $C_{11}$–$C_{18}$ alkyl benzene sulfonates and $C_{10}$–$C_{18}$ primary, branched-chain and random alkyl sulfates, the $C_{10}$–$C_{18}$ secondary (2,3) alkyl sulfates of the formulas $CH_3(CH_2)_x(CHOSO_3^-M^+)CH_3$ and $CH_3\ (CH_2)_y(CHOSO_3^-M^+)\ CH_2CH_3$ wherein x and (y+1) are integers of at least about 7, preferably at least about 9, and M is a water-solubilizing cation, especially sodium, $C_{10}$–$C_{18}$ alkyl alkoxy carboxylates (especially the EO 1-5 ethoxycarboxylates), the sulfated $C_{10}$–$C_{18}$ alkyl polyglycosides, $C_{12}$–$C_{18}$ alpha-sulfonated fatty acid esters, $C_{10}$–$C_{18}$ betaines and sulfobetaines ("sultaines"), $C_{10}$–$C_{18}$ amine oxides, and the like. Use of such surfactants in combination with the aforesaid amine oxide and/or betaine or sultaine surfactants is also preferred for high grease removal performance, depending on the desires of the formulator. Other conventional useful surfactants are listed in standard texts.

Other Ingredients

A wide variety of other ingredients useful in detergent compositions can be included in the (a)+(b) solidified mixtures, or coated thereon, or can simply be admixed with solidified (a)+(b) mixtures in the compositions herein, including other active ingredients, carriers, hydrotropes, processing aids, dyes or pigments, etc. If an additional increment of sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble alkaline earth salts such as $MgCl_2$, $MgSO_4$, $CaCl_2$, $CaSO_4$ and the like, or mixtures thereof, can be added at levels of, typically, 0.1%–2%, to provide additional sudsing and improved grease removal performance.

The detergent compositions herein will preferably be formulated such that, during use in aqueous cleaning operations, the wash water will have a pH between about 6.8 and about 10.5. Finished products thus are typically formulated at this range. Techniques for controlling pH at recommended usage levels include the use of buffers, alkalis, acids, etc., and are well known to those skilled in the art.

The following are typical, nonlimiting examples which illustrate the compositions and uses of this invention.

EXAMPLE VIII

A waxy dishwashing composition with high grease removal properties is as follows. Product pH is adjusted to 7.8.

| Ingredient | % (wt.) |
|---|---|
| $C_{12}$N-(3-methoxypropyl) glucamide | 60.0 |
| $C_{12}$ ethoxy (3) sulfate | 20.0 |
| 2-methyl undecanoic acid | 4.5 |
| $C_{12}$ ethoxy (2) carboxylate | 4.5 |
| $Mg^{++}$ (as $MgCl_2$) | 0.2 |
| $Ca^{++}$ (as $CaCl_2$) | 0.4 |
| Water | 2.0 |
| Filler | Balance |

EXAMPLE IX

A spot remover "stick" which can be rubbed directly onto a spot or stain on a fabric or carpet is as follows.

| Ingredient | % (wt.) |
|---|---|
| $C_{12}$N-(3-methoxypropyl) glucamide | 65 |
| $C_{12-14}$ alcohol ethoxylate (EO3) | 35 |

While the foregoing illustrates the present invention and its use in spot removal and dishwashing compositions, it is not intended to limit the scope of the invention. Indeed, the invention herein can be used in any detergent composition where high sudsing and good grease/oil removal are desired. Thus, the invention herein can be used with various conventional ingredients to provide fully-formulated fabric laundering compositions, hard-surface cleansers, personal cleaning products and the like. Such compositions can be in the form of granules, bars and the like. The high solubility of the N-alkoxy and N-aryloxy polyhydroxy fatty acid amides even allows such compositions to be formulated as modem "concentrated" detergents which contain as much as 30%–60% by weight of surfactants.

Thus, the formulator may wish to employ various builders, typically at levels from 5% to 50% by weight, in compositions designed for fabric laundering. Typical builders include the 1–10 micron zeolites, polycarboxylates such as citrate and oxydisuccinates, layered silicates, phosphates, and the like. Other conventional builders are listed in standard formularies.

Likewise, the formulator may wish to employ various enzymes, such as cellulases, lipases, amylases and proteases in such compositions, typically at levels of from 0.001%–1% by weight. Various detersive and fabric care enzymes are well-known in the laundry detergent art.

Various bleaching compounds, such as the percarbonates, perborates, and the like, can be used in such compositions, typically at levels from 1%–30% by weight. If desired, such compositions can also contain bleach activators such as tetraacetyl ethylenediamine, nonanoyloxybenzene sulfonate, and the like, which are also known in the art. Usage levels typically range from 1%–15% by weight.

Various soil release agents, especially of the anionic oligoester type, various chelating agents, especially the aminophosphonates and ethylenediaminedisuccinates, various clay soil removal agents, especially ethoxylated tetraethylene pentamine, various dispersing agents, especially polyacrylates and polyaspartates, various brighteners, especially anionic brighteners, various suds suppressors, especially silicones and secondary alcohols, various fabric softeners, especially smectite clays, and the like can all be used in such compositions at levels ranging from 1%–35% by weight. Standard formularies and published patents contain multiple, detailed descriptions of such conventional materials.

EXAMPLE X

A granular laundry detergent herein comprises the following.

| Ingredient | % (wt.) |
|---|---|
| $C_{12}$ alkyl benzene sulfonate | 12.0 |
| Solidified surfactant* | 12.0 |
| Zeolite A (1–10 micrometer) | 26.0 |
| $C_{12-14}$ secondary (2,3) alkyl sulfate, Na salt | 5.0 |
| Sodium citrate | 5.0 |
| Sodium carbonate | 20.0 |
| Optical brightener | 0.1 |
| Detersive enzyme** | 1.0 |
| Sodium sulfate | 5.0 |
| Water and minors | Balance |

*1:1 solidified mixture of $C_{12}$ alkyl N-(3-methoxypropyl) glucaniide and ethoxylated $C_{14-16}$ alcohol CEO2.5) added to compositions as admix particles coated with 1 micron zeolite as free-flow aid.
**Lipolytic enzyme preparation (LIPOLASE).

In an alternate mode, a granular laundry detergent is prepared according to Example X using a 2:1 solidified mixture of $C_{12}$N-(3-methoxypropyl)glucamide and $C_{14-16}$ EO(3.0) sulfate as the "solidified surfactant".

EXAMPLE XI

The composition of Example X is modified by including 0.5% of a commercial proteolytic enzyme preparation (ESPERASE) therein. Optionally, 0.5% of a commercial amylase preparation (TERMAMYL), together with 0.5% of a cellulase enzyme preparation (CAREZYME) can be co-incorporated in such compositions.

EXAMPLE XII

The granular fabric laundry composition of Example X is modified by the addition of a bleaching amount of a mixture of sodium percarbonate (300–600 micron), or sodium perborate monohydrate, and a bleach activator such as NOBS and TAED to provide a fabric bleaching function.

EXAMPLE XIII

A laundry bar suitable for hand-washing soiled fabrics is prepared by standard extrusion processes and comprises the following:

| Ingredient | % (wt.) |
|---|---|
| $C_{12-16}$ alkyl sulfate, Na | 20 |
| $C_{12-14}$ N-(3-methoxypropyl)glucamide* | 5 |
| $C_{12-16}$ alcohol ethoxylate (EO6)* | 3 |
| $C_{11-13}$ alkyl benzene sulfonate, Na | 10 |
| Sodium tripolyphosphate | 7 |
| Sodium pyrophosphate | 7 |
| Sodium carbonate | 25 |
| Zeolite A (0.1–10 m) | 5 |
| Coconut monoethanolamide | 2 |
| Carboxymethylcellulose | 0.2 |
| Polyacrylate (m.w. 1400) | 0.2 |
| Brightener, perfume | 0.2 |
| Protease | 0.3 |
| $CaSO_4$ | 1 |
| $MgSO_4$ | |
| Water | 4 |
| Filler** | Balance |

*Prepared from mixed coconut fatty acids. The mixture of glucamide and ethoxylate surfactants is allowed to solidify at room temperature prior to admixture with the balance of the composition and extrusion into bar form.
**Can be selected from convenient materials such as $CaCO_3$, talc, clay, silicates, and the like.

In addition to the foregoing use of the present invention for solidifying otherwise liquid or pasty nonionic surfactants for detergent compositions, it has now been determined that the process of the present invention is useful in the formulation of granular, free-flowing mixtures of N-alkoxy polyhydroxy fatty acid amide/secondary (2,3) alkyl sulfate surfactants/nonionic surfactants. Such $C_{10}$–$C_{18}$ secondary alkyl sulfates having a sulfate moiety at the 2- or 3- carbon atom are of substantial interest as possible replacement surfactants for the well-known alkylbenzene sulfonates. However, the secondary (2,3) alkyl sulfates are often prepared by processes which involve the sulfation of olefins in the presence of various nonionic surfactant-type materials. Thus, the resulting secondary (2,3) alkyl sulfate surfactant, which would in its purified state desirably be in the form of a solid, becomes intermixed with the nonionic material and, thus, is a pasty mass. Inasmuch as detergent formulators encounter substantial difficulties in dealing with pasty materials, a substantial additional effort may be involved in moving the nonionic from the secondary (2,3) alkyl sulfate in order to provide an alkyl sulfate in the form of a dry, free-flowing powder. Recognizing this problem, the present invention contemplates the solution to this tackiness issue by adding an N-alkoxy polyhydroxy fatty acid amide surfactant to tacky secondary (2,3) alkyl sulfates contaminated with nonionic surfactants, whereby the tacky mass is substantially solidified and can be converted into particle form for direct addition to granular laundry detergents. Typically, weight ratios of N-alkoxy polyhydroxy fatty acid amide:nonionic surfactant in such solidified mixtures are from about 10:1 to 1:10, preferably in the range of about 3:1 to 1:3, most preferably 3:1 to 1:1.

What is claimed is:

1. A solidified detergent composition comprising:

(a) at least about 1% by weight of an amide surfactant of the formula

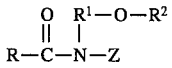

wherein R is a $C_7$–$C_{21}$ hydrocarbyl moiety, $R^1$ is a $C_2$–$C_8$ hydrocarbyl moiety, $R^2$ is a $C_1$–$C_8$ hydrocarbyl or oxy-hydrocarbyl moiety, and Z is a polyhydroxy hydrocarbyl unit having a linear chain with at least two hydroxyls directly connected to the chain; and (b) at least about 1% by weight of a member selected from the group consisting of alkoxylated nonionic surfactants, sulfated alkoxylated anionic surfactants, and mixtures thereof.

2. A composition according to claim 1 wherein substituent Z of amide surfactant (a) is derived from a reducing sugar.

3. A composition according to claim 2 wherein Z is derived from a reducing sugar which is a member selected from the group consisting of glucose, fructose, maltose, galactose, mannose, xylose and mixtures thereof.

4. A composition according to claim 1 wherein $R^1$ is ethylene or propylene and $R^2$ is methyl.

5. A composition according to claim 4 wherein $R^1$ is ethylene, $R^2$ is methyl, and Z is derived from glucose.

6. A composition according to claim 1 wherein surfactant (b) is a $C_8$–$C_{22}$ alkoxylated alcohol or alkoxylated $C_6$–$C_{12}$ alkyl phenol.

7. A composition according to claim 6 wherein surfactant (b) is an ethoxylated $C_8$–$C_{22}$ alcohol.

8. A composition according to claim 1 wherein surfactant (b) is a sulfated $C_{10}$–$C_{20}$ alcohol ethoxylate.

9. A composition according to claim 8 wherein surfactant (b) is a mixture of $C_{10}$–$C_{20}$ alcohol ethoxylate and a sulfated $C_{10}$–$C_{20}$ alcohol or alkyl phenol ethoxylate.

10. A composition according to claim 1 which additionally comprises at least about 1% by weight of an additional surfactant which is a member selected from the group consisting of alkoxy carboxylate, amine oxide, betaine and sultaine surfactants, and mixtures thereof.

11. A composition according to claim 1 which additionally comprises at least about 0.05% by weight of calcium ions, magnesium ions, or mixtures thereof.

12. A method for cleaning fabrics, hard surfaces or dishware, comprising contacting said fabrics, hard surfaces or dishware with an aqueous medium which contains at least about 200 ppm of a composition according to claim 1.

* * * * *